US011332978B1

(12) United States Patent
Munguia

(10) Patent No.: US 11,332,978 B1
(45) Date of Patent: May 17, 2022

(54) OFFSET COUPLING FOR MUD MOTOR DRIVE SHAFT

(71) Applicant: Halliburton Energy Services, Inc., Houston, TX (US)

(72) Inventor: Joseph Robert Munguia, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/094,963

(22) Filed: Nov. 11, 2020

(51) Int. Cl.
*E21B 4/02* (2006.01)
*E21B 4/00* (2006.01)
*E21B 3/00* (2006.01)

(52) U.S. Cl.
CPC ..... *E21B 4/02* (2013.01); *E21B 3/00* (2013.01); *E21B 4/006* (2013.01)

(58) Field of Classification Search
CPC ..... E21B 4/02
See application file for complete search history.

(56) References Cited

U.S. PATENT DOCUMENTS 4,080,115 A * 3/1978 Sims ..... E21B 4/02 175/107
5,139,400 A * 8/1992 Ide ..... E21B 4/02 175/107
5,248,896 A * 9/1993 Forrest ..... F03B 13/02 175/107
6,155,807 A 12/2000 Fenton
9,334,691 B2 5/2016 Jarvis et al.
2010/0187009 A1* 7/2010 Siher ..... E21B 4/006 175/57
2012/0132470 A1 5/2012 Jarvis et al.
2015/0211481 A1 7/2015 Mehta et al.
2015/0354280 A1 12/2015 Downton et al.
2016/0017693 A1 1/2016 Winslow et al.
2016/0208556 A1 7/2016 Gawski et al.
2016/0230462 A1 8/2016 Mehta et al.

FOREIGN PATENT DOCUMENTS

JP 2008-223492 A 9/2008
WO 91-05939 A1 5/1991

OTHER PUBLICATIONS

International Search Report and Written Opinion for Application No. PCT/US2020/061037, dated Jul. 21, 2021.

* cited by examiner

*Primary Examiner* — Giovanna Wright
(74) *Attorney, Agent, or Firm* — Benjamin Ford; C. Tumey Law Group PLLC

(57) ABSTRACT

A rotary transfer mechanism is disclosed for a motor, pump, or other downhole tool that accommodates the eccentric motion of a rotor without the need for a flex shaft, articulating joint or CV joint. In one configuration, the rotor is coupled to the drive shaft at a radial offset from the drive shaft axis. The orbiting motion of the rotor, rather than rotation of the rotor about its own axis, generates a torque on the drive shaft, by applying a tangential force to the drive shaft at the location of the radial offset. The radial offset may be set equal to the orbital radius so that no radial movement or flex is required at the drive shaft to accommodate the eccentric rotor movement.

20 Claims, 5 Drawing Sheets

OFFSET COUPLING FOR MUD MOTOR DRIVE SHAFT

BACKGROUND

Wells are constructed for the potential recovery of hydrocarbons such as oil and gas from underground formations. Typically, a well is drilled with a tubular drill string that is progressively assembled to reach the desired well depth. A casing string may then be lowered into selected portions of the wellbore and cemented in place to reinforce the wellbore. The casing may be perforated at selected intervals to provide flowpaths for extracting hydrocarbon fluids from a production zone(s) of the formation. The formation may also be stimulated such as by hydraulically fracturing or acidizing the formation in the vicinity of the production zone. Finally, a production tubing string may be run into the well to the production zone, protecting the casing and providing a flow path to a wellhead through which the oil and gas can be produced.

Each of the phases of well construction may be costly and labor-intensive. One aspect of the cost is the challenge of working in a harsh downhole environment, which may expose tools to high temperatures, pressures, forces, and a multitude of potentially corrosive or reactive working fluids and formation fluids. Tools and methods must be designed and built to withstand the harsh downhole environment. A tool is often required to be run in multiple trips into a single well. Some tools are used repeatedly as part of a fleet and are maintained with the expectation that they function reliably over the life of many wells.

Downhole motors and pumps are examples of tools that encounter high stresses. Certain motor and pump designs involve the flow of pressurized fluid through a plurality of cavities defined between a rotor and stator, which results in eccentric motion of the rotor. The eccentric motion and corresponding interaction between various components can be both mechanically complex and stressful. Past efforts to accommodate the eccentric motion of tools like mud motors have included the use of articulating joints and/or constant velocity (CV) joints to accommodate multiple degrees of movement. These special joints increase complexity and possible failure modes. Flexible shafts (i.e. flex shafts) have also been tried to reduce reliance on these types of joints, but can induce high bending moments to surrounding components.

BRIEF DESCRIPTION OF THE DRAWINGS

These drawings illustrate certain aspects of some of the embodiments of the present disclosure and should not be used to limit or define the disclosure.

DETAILED DESCRIPTION

A rotary transfer mechanism is disclosed for use with tools such as motors and pumps, to accommodate eccentric motion of a rotor without the need for articulating joints, CV joints, or flex shafts. The rotor may both rotate about its own axis, while simultaneously orbiting around another axis such as the stator axis (which may be in opposite directions). The rotor may be coupled to the drive shaft at a radial offset from the drive shaft axis, such that the orbiting motion of the rotor applies a torque to the drive shaft. As a result, in at least some embodiments, rotation may be transferred from the rotor to the drive shaft by the orbiting motion, rather than by rotation of the rotor about its own axis. A bearing may be provided to allow relative rotation between the rotor and the drive shaft where the rotor is coupled to the drive shaft (e.g. a bearing at an offset pin).

In one configuration, the rotor may be coupled to the drive shaft using an offset pin, which is radially offset from the drive shaft axis by some amount. The amount of radial offset may be equal to the orbital radius of the rotor as measured by the movement of the rotor axis with respect to the stator axis, so that the offset pin travels on the same radius (distance from the drive shaft axis and/or BHA axis) as the rotor. A bearing may be provided on the drive shaft to support rotation of the drive shaft about the drive shaft axis. Another bearing may be provided at the offset pin to support relative rotational movement between the drive shaft and rotor where they are coupled. The rotor may therefore rotate about the rotor axis and simultaneously orbit about another, e.g. stator axis, and no radial movement is required at the drive shaft to accommodate this motion. Thus, the need for a flex shaft, CV joint, or articulating joint may be eliminated in at least some embodiments.

Figure 1:
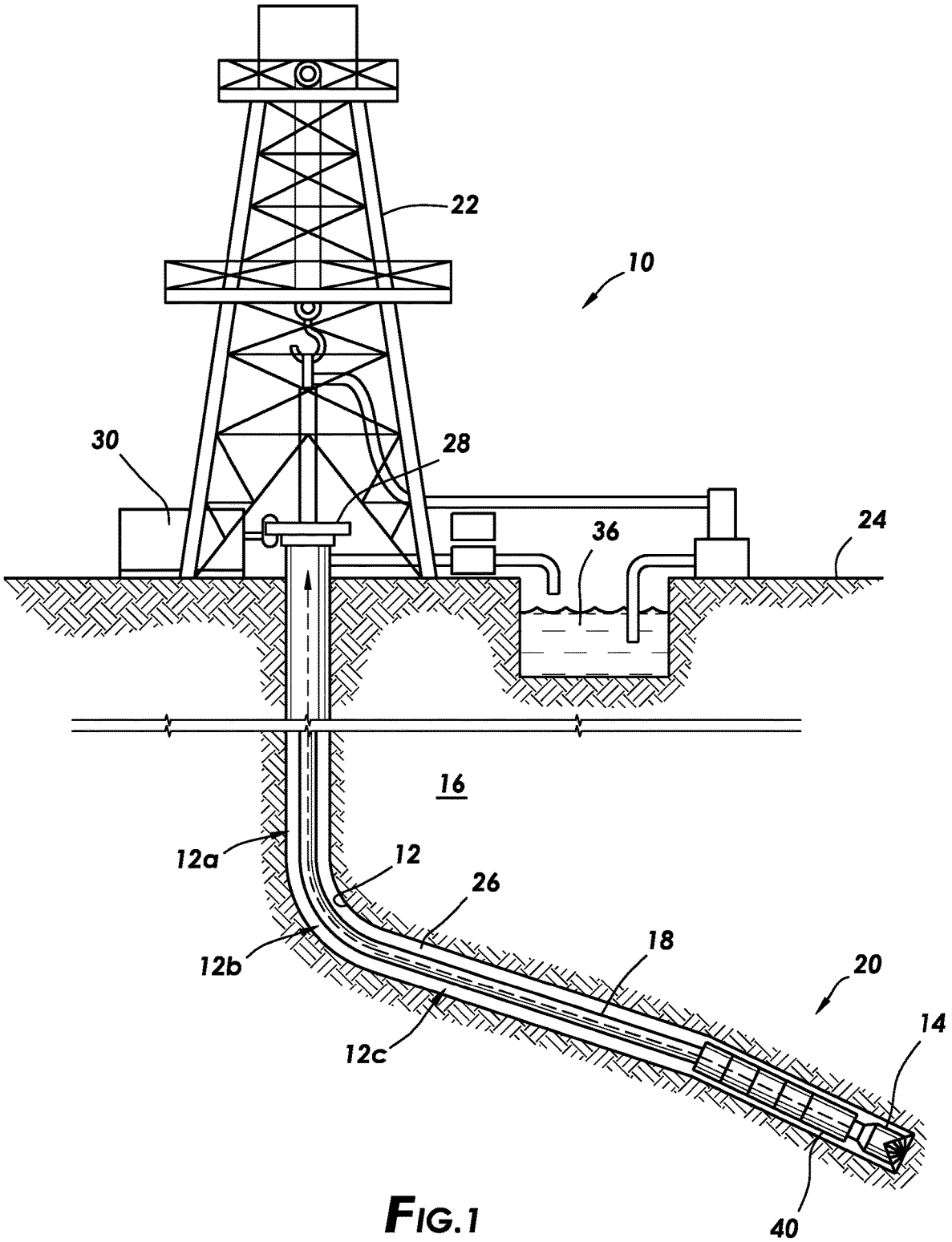
FIG. 1 is an elevation view of a representative drilling system 10 in which a rotary transfer mechanism may be implemented according to one or more embodiments of the present disclosure.

For context, FIG. 1 provides an elevation view of a representative drilling system 10 in which a rotary transfer mechanism may be implemented according to one or more embodiments of the present disclosure. The rotary transfer mechanism is used in this example with a mud motor 40, but may alternatively be used with other tools, such as pumps, that rely on the flow of a working fluid through a progressing cavity defined by a rotor and stator. Although drilling system 10 is illustrated in the context of a terrestrial drilling operation, it will be appreciated by those skilled in the art that aspects of the disclosure may also be practiced in connection with offshore platforms and or other types of hydrocarbon exploration and recovery systems.

The drilling system 10 is used in forming a wellbore 12 traversing a geologic formation 16. A drilling rig 22 at the surface 24 of the wellsite provides a support structure and surface equipment for drilling. A drill string 18 is supported from the drilling rig 22 and may be progressively assembled by adding segments of tubing as the well is drilled. A bottomhole assembly (BHA) 20 generally depicted at a lower end of the drill string 18 includes a rotary drill bit 14, mud motor 40, and other components not explicitly shown such as bearing assemblies, steering mechanisms, measurement, and telemetry systems. The rotary drill bit 14 includes cutting structures that, when rotated, cut into the geological formation 16 such as by shearing, scraping, gouging, or otherwise disintegrating the formation material. The drill bit 14 may be rotated by rotating the entire drill string 18 from the surface using a turntable 28 powered by an engine 30 on the drilling rig 22. The drill bit 14 may also be rotated by the mud motor 40 relative to the drill string 18.

The option to rotate the drill bit 14 using either the mud motor 40 or the drill string 18 has a variety of different uses. For example, in directional drilling, a bent housing (not explicitly shown) in the BHA 20 may be used to provide a directional bias to the lower end of the drill string. To drill a straight section, the drill string 18 and the drill bit 14 may be rotated together, in what may be called a rotating mode. In rotating mode, the bent housing turns with the rest of the drill string 18 to eliminate the effect of the directional bias on the trajectory of the wellbore 12 as it is being drilled. To deviate from the current drilling trajectory, drill string rotation may be halted and the drill bit 14 rotated using only the mud motor 40, in what may be called a sliding mode. The bent housing remains rotationally stationary, so the directional bias of the bent housing causes a directional change as drilling progresses. Thus, any number of straight or deviated sections may be drilled by selectively rotating or not rotating the drill string 18 during drilling. FIG. 1 shows, for example, a vertical section 12*a*, a build section 12*b*, and a tangent section 12*c*.

While drilling, pressurized drilling fluid (i.e. mud) 36 may be flowed down the drill string 18 and up through an annulus between the drill string 18 and formation 16, to lubricate the drill bit 14 and remove cuttings to the surface 24. That same pressured drilling fluid 36 may be used to power the mud motor 40, which generates torque in response to the circulation of the drilling fluid 36. The mud 36 also lubricates the rotary drill bit 14 and flushes geologic cuttings from the path of the rotary drill bit 14. The mud 36 exiting the drill bit 14 flows up through an annulus 26 defined between the drill string 18 and the geologic formation 16. The geologic cuttings and other debris are carried by the mud 36 to the surface 24 where the cuttings and debris can be removed from the mud stream.

Figure 2:
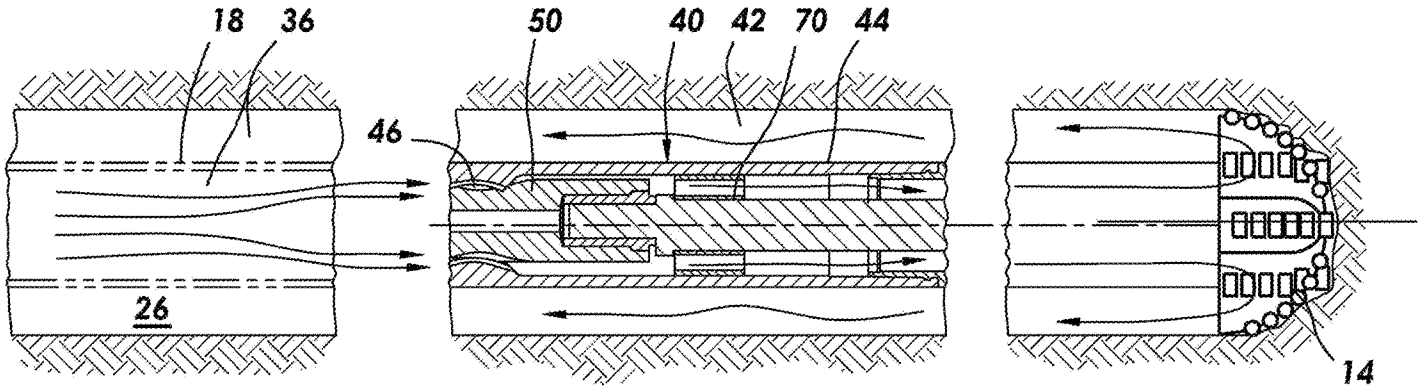
FIG. 2 is a side view of the mud motor run by the drilling system of FIG. 1.

FIG. 2 is a side view of the mud motor 40 run by the drilling system 10 of FIG. 1 according to an example configuration. The motor 40 is included with a lower end of drill string 18 to optionally drive rotation of the drill bit 14. The motor 40 is cut away to reveal a portion of a rotary transfer mechanism 42, which includes a rotor 50 coupled to a drive shaft 70 and disposed within a motor housing 44. Pressurized mud 36 is shown flowing down through the drilling string 18 to the mud motor 40. When it is desired to power the drill bit 14 with the motor 40, the pressured mud 36 can be directed through a progressing cavity 46 defined by a plurality of helical stator lobes further discussed below. The flow through the motor 40 causes a rotary motion of the rotor 50. Within the rotary transfer mechanism 42, rotary motion of the rotor 50 is transferred to the drive shaft 70 as discussed below, which drives rotation of the drill bit 14. The flow path of the mud 36 continues downhole from the mud motor 40, out through nozzles on the drill bit 14, and up through the annulus 26, to wash away formation cuttings and other debris.

Figure 3:
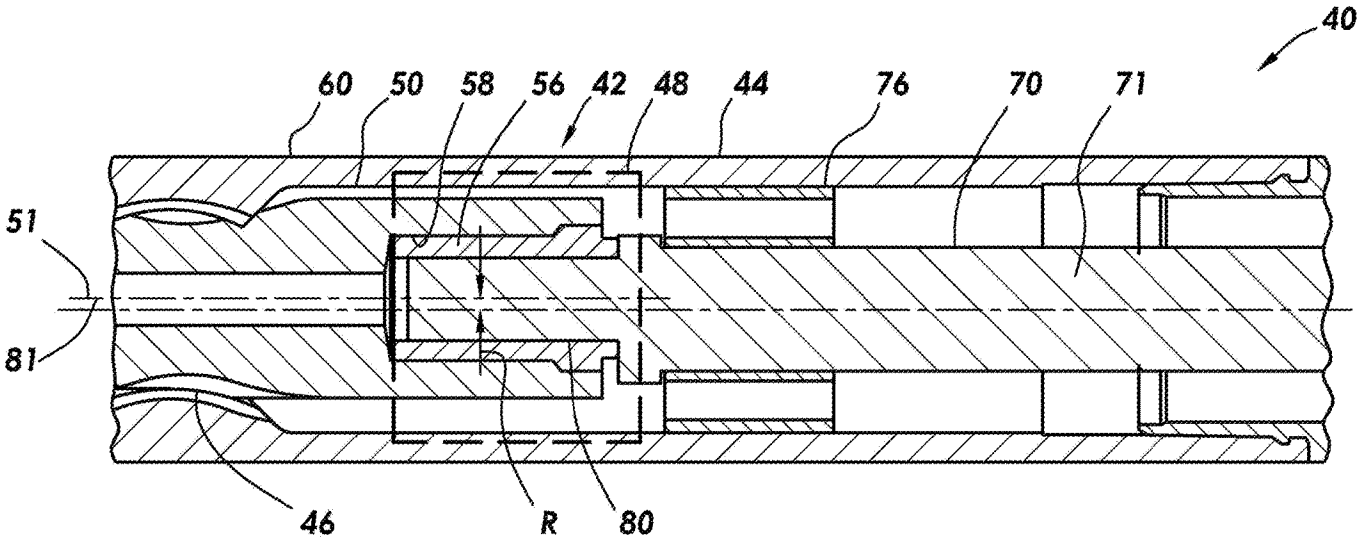
FIG. 3 is an enlarged view of the mud motor further detailing the motor and the rotary transfer mechanism of FIG. 2.

FIG. 3 is an enlarged view of the mud motor 40 further detailing the motor 40 and the rotary transfer mechanism 42 of FIG. 2. The motor 40 includes a stator 60 that is fixed relative to the motor housing 44. The stator 60 may be a separate part secured to the motor housing 44, or the motor housing 44 may itself be the stator 60. The rotor 50 is moveably disposed inside the stator 60 in this configuration, such that the rotor moves around the inside of the stator 60, although an alternate configuration could instead have a stator disposed inside a rotor, wherein the rotor moves around the outside of the stator. The drive shaft 70 is rotatably supported about a drive shaft axis 71. The structure comprising the motor housing 44 may extend past the rotor 50 to also house the drive shaft 70, either as a single, unitary housing section or separate housing sections coupled together end to end. Although not required, the drive shaft 70 and motor housing 44 are both of generally circular cross-section, with the drive shaft 70 centered within the housing 44, such that the drive shaft axis 70 is coaxial with the stator 60 in this embodiment. (Coaxial in this context refers to having a common geometrical axis and does not necessarily imply that one item is inside the other.) The rotor 50 follows a compound movement with respect to the stator 60, including rotation of the rotor about its own axis (rotor axis) 51 and an eccentric component wherein the rotor axis 51 simultaneously orbits about an orbital axis. The orbital axis coincides with a stator axis and the drive shaft axis 71 in this configuration.

The rotor 50 is coupled to a drive shaft 70 at a location radially offset from the drive shaft axis 71 by a radial offset "R." More particularly, in this embodiment, the rotor 50 is coupled to the drive shaft 70 at an interface or coupling 48 that includes a pin 80 on the drive shaft 70 received within a pin receptacle 58 on the rotor 50. The pin 80 has a pin axis 81 that is parallel to and offset from the drive shaft axis 71 by the radial offset R. The pin 80 is coaxial (centrally disposed within) the rotor 50 in this embodiment, i.e. the rotor axis 51 aligns with pin axis 81, and the stator 60 is radially aligned with the drive shaft 70, so that the rotor axis 51 orbit about the drive shaft axis 71. Alternative configurations are possible within the scope of this disclosure wherein the stator is not necessarily aligned with the drive shaft, in which case the drive shaft axis does not necessarily coincide with the orbital axis. The orbiting of the rotor 50 thereby drives rotation of the drive shaft 70 by applying a tangential force to the drive shaft 70 via the pin 80 at a moment arm equal to the radial offset R, with a resulting torque applied to the drive shaft 70. In at least this embodiment, the orbital radius matches the radial offset R, so that no radial movement of the drive shaft axis 71 is required (e.g. no articulating joint or flex shaft required) to accommodate the eccentric movement of the rotor 50.

Bearings are optionally included to support relative rotation between parts. In FIG. 3, a first bearing, referred to as rotor bearing 56, supports relative rotation between the drive shaft 70 and rotor 50 about the rotor axis 51. More particularly, the pin 80 will rotate within the pin receptacle 58 as the rotor 50 orbits and applies the tangential force to the drive shaft 70 at pin 80. The rotor bearing 56 is disposed between the pin 80 and the pin receptacle 58 and may be a type of roller bearing or may be a fixed bearing with a low-friction material. A second bearing, referred to as a drive shaft bearing 76, supports rotation of the drive shaft 70 about its own, drive shaft axis 71. The drive shaft bearing aligns the drive shaft axis 71 with the stator axis 61. The drive shaft bearing 76 in this configuration also serves as a spacer, or more specifically a centralizer, to radially position and centralize the drive shaft 70 within the housing 44.

According to this structure and the various modifications within the scope of this disclosure, the drive shaft 70 is not required to articulate (e.g. using an articulating joint and/or CV joint), nor flex, to accommodate the eccentric motion of the rotor 50. The drive shaft axis 71 may remain level, parallel with the rotor axis 50, and parallel with the stator axis 61 (e.g., FIG. 4). Since no radial movement of the drive shaft 70 is required to accommodate the eccentric movement of the rotor 50, the drive shaft bearing 76 may abut an inner diameter of the housing 44 to better support the drive shaft 70 and prevent lateral/radial movement of the drive shaft 70, which provides a very stable rotational transfer between the rotor 50 and drive shaft 70.

It should be recognized that a rotary transfer mechanism according to this disclosure is not limited to use with a mud motor, wherein powered rotation of the rotor drives rotation of the drive shaft. One of ordinary skill will appreciate, for example, that the rotary transfer mechanism 42 of FIG. 3 could be used in a different downhole system and operated in a sort of a reverse fashion as a pump. Specifically, rotation of the drive shaft 70 may be powered, e.g., from a motor on the right, in the opposite direction as described above, to apply a torque to the rotor 50 at the offset pin 80. The motion of the rotor 50 is thereby reversed, to pump a working fluid from right to left. Such a pump would have some or all the technical advantages described herein, such as avoiding the need for an articulating joint or flex shaft to accommodate the eccentric motion of the rotor 50.

Figure 4:
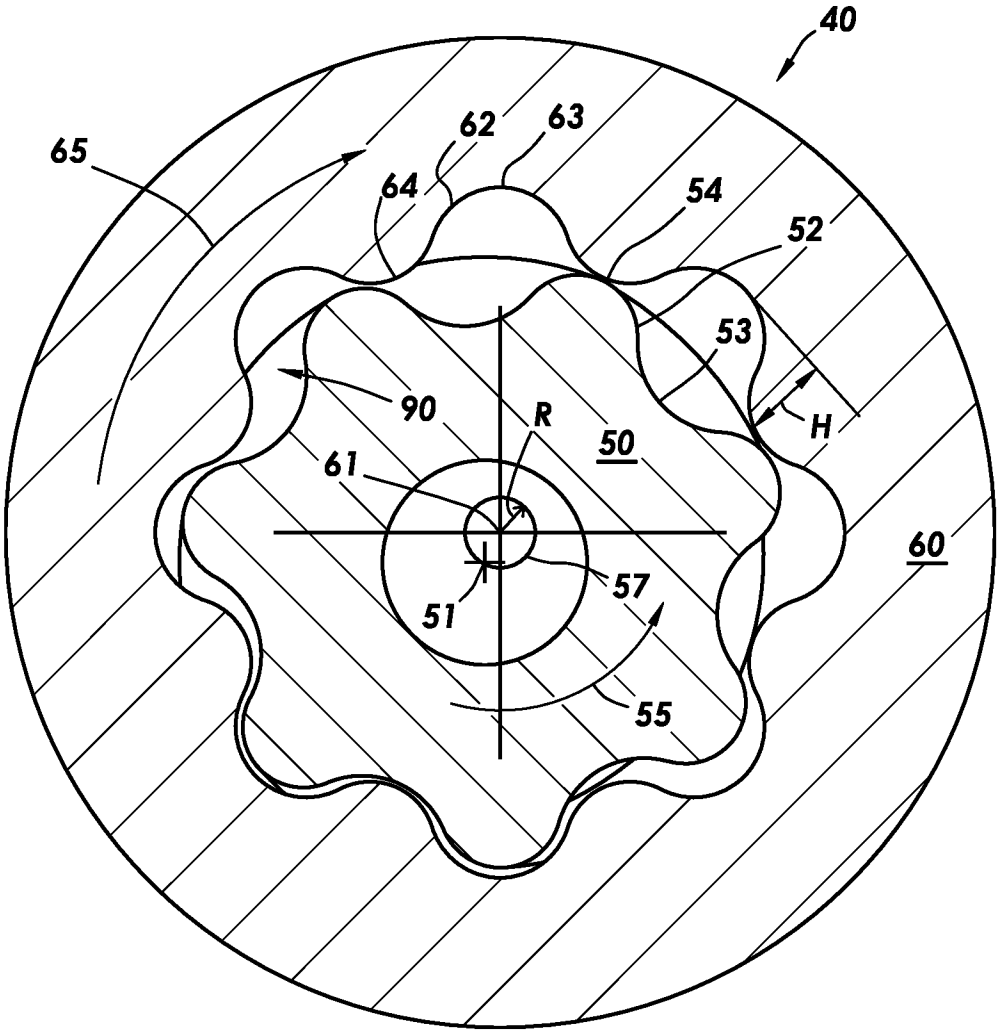
FIG. 4 is a cross-sectional view of the mud motor for further discussing the eccentric movement of the rotor with respect to the stator.

FIG. 4 is a cross-sectional view of the mud motor 40 illustrating the eccentric movement of the rotor 50 that drives rotation of the drive shaft 70 of FIG. 3. As was explained in FIG. 3, the rotor 50 is coupled to the drive shaft 70 at the offset pin 80, such that the rotor 50 and offset pin 80 are coaxial (i.e. rotor axis 51 coincides with the center of the offset pin 80.) In this configuration, the rotor 50 is moveably disposed inside the stator 60, although it is possible to alternately configure it with a stator disposed inside a rotor. The rotor 50 has an undulating outer surface 52 that meshes with an undulating inner surface 62 of the stator 60. The outwardly extending portions of the undulating outer surface 52 are referred to herein as rotor lobes 54, with corresponding rotor recesses 53 therebetween. The inwardly extending portions of the undulating inner surface 62 of the stator 60 are referred to herein as the stator lobes 64, with corresponding stator recesses 63 therebetween. By design, the rotor 50 has one fewer rotor lobe 54 than the stator 60 has stator lobes 64. In this configuration, the stator 60 includes 8 stator lobes 64, and the rotor 50 includes 7 rotor lobes 54.

A plurality of cavities 90 are defined between the rotor 50, stator 60, and the respective lobes 54, 64, which extend axially (into and out of the page) in a sort of helical arrangement. As fluid passes through the cavities 90, the undulating outer surface 52 of the rotor 50 rolls along the undulating inner surface 62 of the stator 60. In so doing, the rotor 50 simultaneously rotates about its own rotor axis 51 in one direction (in this example, a counter-clockwise direction 55) as the rotor axis 51 orbits about the stator axis 61 in the opposite (in this example clockwise) direction 65. The generally circular orbital path traced by the rotor axis 51 as it orbits around the stator axis 61 is indicated at 57. Each 360-degree orbital revolution of the rotor 50 rotates the drive shaft 70 a full rotation about the drive shaft axis 71. (The rotor 50 only rotates a fraction of a turn about its own rotor axis 51 per orbital revolution, as will be further discussed below in relation to FIG. 5.)

Still referring to FIG. 4, the torque applied by the rotor 50 to the drive shaft 70 may be affected by a magnitude of the orbital radius of the rotor axis 51 about the stator axis 61. The rotor 50 is coupled to the drive shaft along the rotor axis 51, which in this embodiment coincides with the circular orbit 57 about the stator axis 61. The moment arm in this case is equal to the radial offset "R" labeled here again for reference. In designing a rotary transfer mechanism for a particular application, the radial offset "R" is one of the variable that may be selected to select a desired moment arm applied by the rotor 50 to the drive shaft, torque at that location. Increasing R may increase the torque applied, and vice-versa. The rotor and stator geometry, including but not limited to the diameters of the rotor 50 and stator 60, the heights of the rotor lobes 54 and stator lobes 64, and the number of lobes 54, 64, may all have an effect on the offset radius R, the amount of torque and RPMs (revolutions per minute), and so forth. For example, increasing a height "H" of the stator lobes 64 may allow for increasing the offset radius R, which may in turn lead to changing the diameters of the stator 60 and/or rotor 50 in the design.

Figure 5:
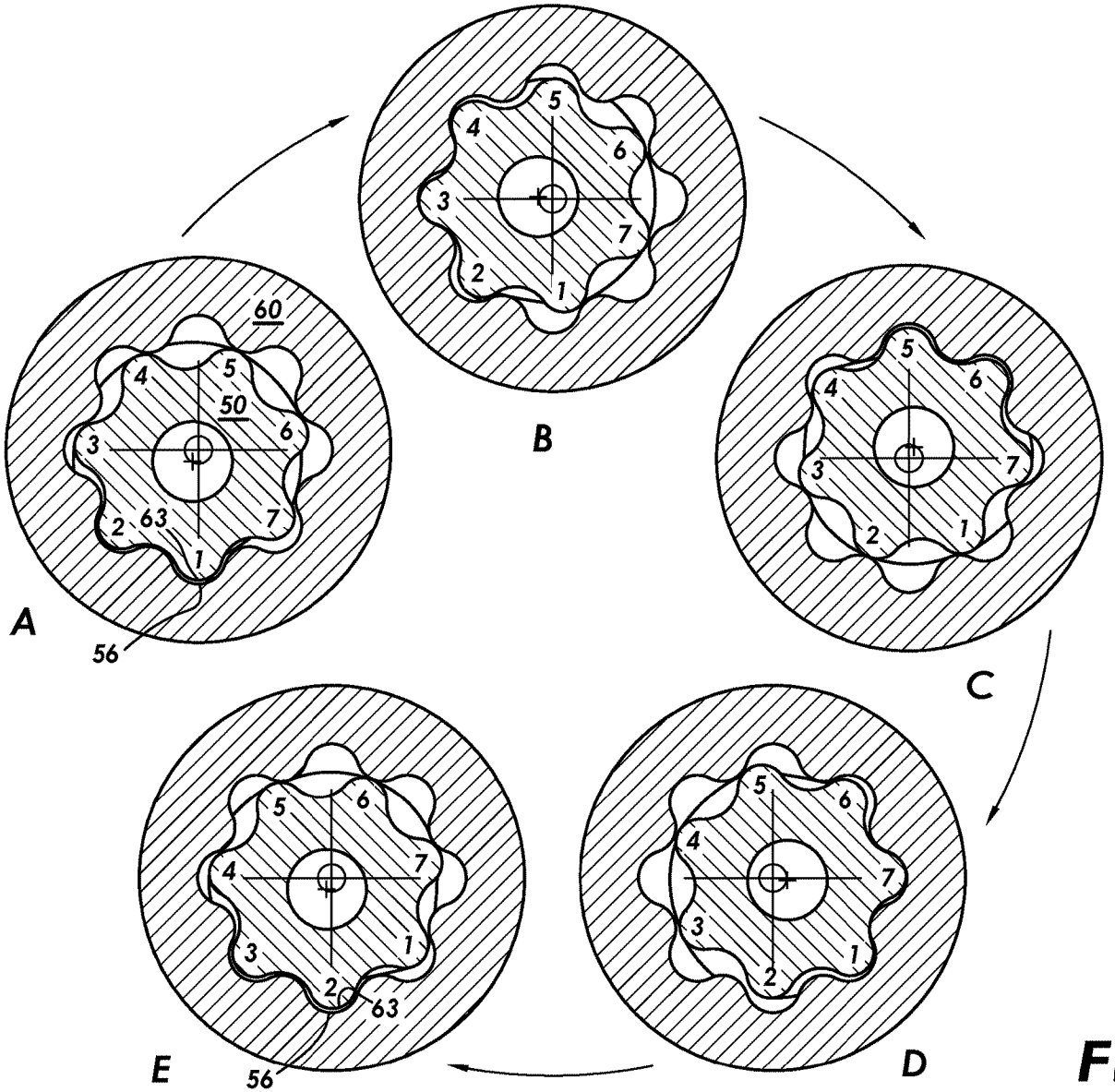
FIG. 5 is a sequential diagram of the motor as the rotor completes one full clockwise orbital revolution about the stator.

FIG. 5 is a sequential diagram of the motor 40 of FIG. 4 to help visualize the simultaneous rotation of the rotor about its own rotor axis 51 as it simultaneously orbits in the other direction. The sequence shows the rotor 50 completing one full clockwise orbital revolution about the stator 60 from its initial position at "A" at the bottom of the stator 60 all the way to that same orbital position at "E." To help visualize the movement of the rotor 50, the seven rotor lobes 54 are labeled from 1 to 7. At "A" the rotor lobe 54 labeled "1" is initially at a bottom of the stator 60 (with respect to the orientation of the view of FIG. 5), within one of the stator recesses 63. As can be seen, one full orbit (360 degrees clockwise) of the rotor 50 inside the stator 60 advances the rotor 50 by one rotor lobe 54 counter-clockwise so that the adjacent rotor lobe 54 labeled "2" replaces the rotor lobe labeled "1" after one full orbit from "A" to "E." It would take seven full orbits for the rotor lobe labeled "1" to return to its initial position shown at "A." Thus, the rate of rotation of the drive shaft 70 around the drive shaft axis 71 (FIG. 3) will be equal to the rate at which the rotor 50 orbits, which will be seven times the rotation rate of the rotor 50 about the rotor axis 51. This may be different (e.g. higher bit speed and lower torque) than in a conventional mud motor wherein the rotation of the rotor (rather than the orbiting of the rotor) may drive rotation of a drive shaft, for a 1:1 correspondence between the rotation rate of the rotor and the rotation rate of the drive shaft. This aspect may be factored into the design of the mud motor to achieve the desired balance of torque to drill bit speed.

It can be seen that in the case of a motor having N stator lobes and N−1 rotor lobes, the drill bit speed is N−1 times the rotor speed about its own rotor axis. Thus, another parameter that may be varied is the number of rotor and stator lobes in the motor. In the example of FIGS. 4 and 5, there are N=8 stator lobes and N−1=7 rotor lobes, and the drill bit speed is 7 times the rotor speed. This ratio of drill bit speed to rotor speed may be varied by changing the number rotor and stator lobes. For example, a motor with N=7 stator lobes and N−1=6 rotor lobes may multiply the drill bit speed by a factor of 6. A motor with N=5 stator lobes and N−1=4 rotor lobes may multiple the drill bit speed by a factor of 5. And so on.

Figure 6:
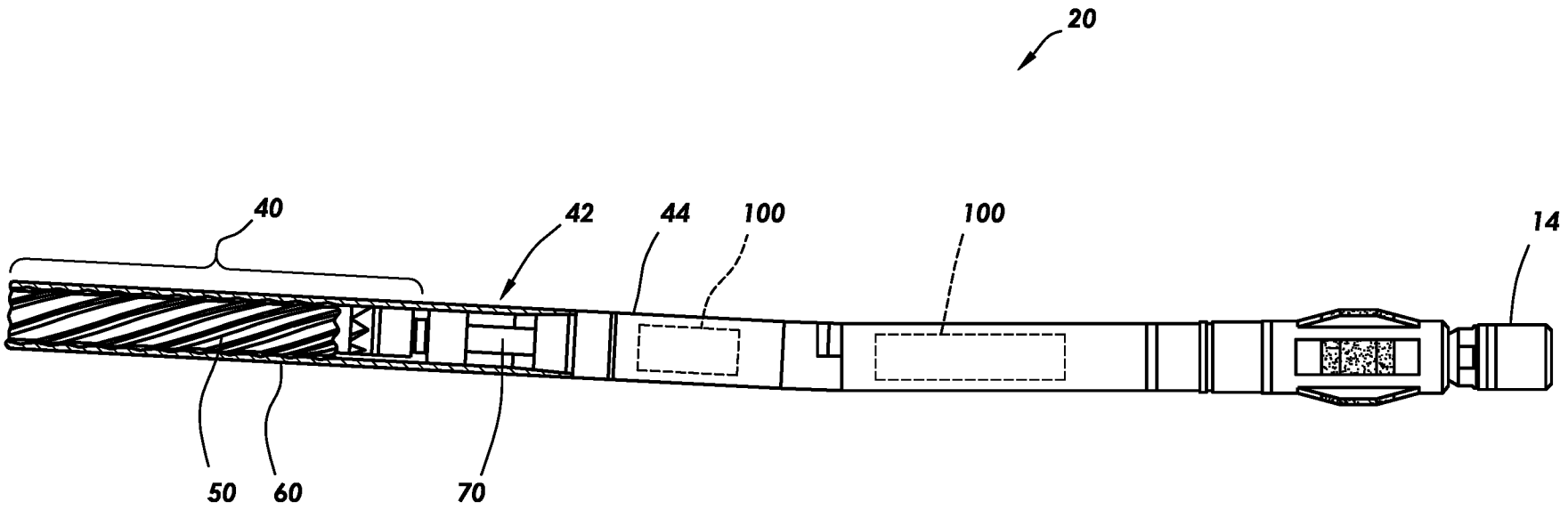
FIG. 6 is a side view of an example BHA wherein the drive shaft is coupled to the drill bit by an intermediate gearbox.

Yet another way to obtain a desired ratio of drill bit speed to rotor speed is with the addition of a gear box between the drive shaft and drill bit. FIG. 6 is a side view of an example BHA 20 wherein the drive shaft 70 is coupled to the drill bit 14 by an intermediate gearbox 100 somewhere along the housing 44, such as at either of two alternative locations indicated in dashed linetype. The rotor 50 may still drive rotation speed of the drive shaft 70 by a factor of N−1 times the rotation speed of the rotor 50 about its own axis as described in FIG. 5. However, the optional gearbox 100 may then step down that drive shaft speed so that the drill bit speed is some value less than the drive shaft speed, closer to the rotation speed of the rotor 50 about its own axis. In one example, while the rotary transfer mechanism 42 steps up the speed of the drive shaft 70 relative to the rotor 50 by a factor of N−1 as described above, the gearbox 100 may step down the drill bit speed, in one example, by the same factor of N−1, such that the drill bit speed is about equal to the speed of the rotor 50 about its own axis. Thus, the rotary transfer mechanism 42 may desirably power rotation of the drive shaft 70 without requiring the complexity of a flex shaft, CV joint, or articulating joint that might otherwise be required in a conventional mud motor, but while still achieving the desired drill bit speed, and without necessarily increasing the expected drill bit speed as compared with conventional mud motors.

In addition to various apparatus, aspects of this disclosure further include methods of transferring rotation from a rotor to or from a drive shaft, and in particular, methods that do not require radial movement of any part of the drive shaft to accommodate the eccentric motion of the rotor. One example method involves flowing a pressurized fluid through a plurality of cavities defined by helical rotor lobes and stator lobes, such that the rotor rotates about its rotor axis while simultaneously orbiting about another axis, such as the stator axis. The method may further include supporting a drive shaft about a drive shaft axis, and more specifically, supporting the drive shaft so the drive shaft axis remains level and parallel to the housing and/or to a stator axis as it rotates about its drive shaft axis. The method further includes coupling the rotor to the drive shaft at a radial offset from the drive shaft axis, and preferably, where the radial offset is equal to an orbital radius of the rotor. The method also includes applying a tangential force by the rotor to the drive shaft as it orbits. The orbiting of the rotor, rather than rotation of the rotor about its rotor axis, may drive rotation of the drive shaft.

Thus, a rotary transfer mechanism has been disclosed, which may be used in a positive displacement motor, pump, or other downhole tool, wherein a rotor may transfer rotation to a drive shaft by the orbiting motion, rather than by rotation of the rotor about its own axis. This may eliminate radial movement of the drive shaft, thereby avoiding the need for flex shafts, articulating joints, or the like. The systems and methods of the present disclosure may include any of the various features disclosed herein, in any viable combination, including but not limited to anything discussed above and any of the following statements.

Statement 1. A rotary transfer mechanism for use downhole, comprising: a stator having a plurality of helical stator lobes; a rotor having a rotor axis and a plurality of helical rotor lobes disposed about the rotor axis, the stator lobes and rotor lobes cooperating to define a plurality of cavities between the rotor and stator, such that the rotor rotates about the rotor axis while the rotor orbits about a stator axis; a drive shaft rotatably supported about a drive shaft axis; and wherein the rotor is coupled to the drive shaft at a radial offset from the drive shaft axis.

Statement 2. The rotary transfer mechanism of Statement 1, wherein the drive shaft is coaxial with the stator, and the rotor axis is at the radial offset from the drive shaft axis.

Statement 3. The rotary transfer mechanism of Statement 1 or 2, wherein the radial offset is equal to an orbital radius of the rotor axis about the stator axis.

Statement 4. The rotary transfer mechanism of any of Statements 1 to 3, wherein the rotor is coupled to the drive shaft using an offset pin that is coaxial with the rotor and radially offset from the drive shaft axis.

Statement 5. The rotary transfer mechanism of any of Statement 1 to 4, further comprising one or both of a rotor bearing supporting relative rotation between the drive shaft and rotor about the rotor axis and a drive shaft bearing supporting rotation of the drive shaft about the drive shaft axis.

Statement 6. The rotary transfer mechanism of any of Statements 1 to 5, further comprising a housing, wherein the drive shaft bearing radially secures the drive shaft within the housing.

Statement 7. The rotary transfer mechanism of any of Statements 1 to 6, wherein the drive shaft bearing holds the drive shaft axis in alignment with the stator axis.

Statement 8. The rotary transfer mechanism of any of Statements 1 to 7, wherein the drive shaft is supported such that the drive shaft axis remains parallel with the rotor axis as the rotor axis orbits.

Statement 9. The rotary transfer mechanism of any of Statements 1 to 8, wherein the rotor orbits without flexure of the drive shaft.

Statement 10. The rotary transfer mechanism of any of Statements 1 to 9, wherein the drive shaft is supported without an articulating joint at either end.

Statement 11. The rotary transfer mechanism of any of Statements 1 to 10, wherein the rotor is disposed inside the stator.

Statement 12. The rotary transfer mechanism of any of Statements 1 to 10, wherein the stator is disposed inside the rotor.

Statement 13. The downhole rotary transfer mechanism of any of Statements 1 to 12, wherein the rotor and stator cooperate as a motor with a pressurized fluid source in fluid communication with the plurality of cavities to drive the rotor with respect to the stator.

Statement 14. A positive displacement motor, comprising: a stator having a stator axis and a plurality of helical stator lobes disposed about the stator axis; a rotor having a rotor axis and a plurality of helical rotor lobes disposed about the rotor axis, the stator lobes and rotor lobes cooperating to define a plurality of cavities between the rotor and stator; a pressurized fluid source in fluid communication with the plurality of cavities to drive rotation of the rotor with respect to the stator such that the rotor axis orbits at an orbital radius about the stator axis while the rotor rotates about the rotor axis; a drive shaft rotatably supported about a drive shaft axis, wherein the rotor is coupled to the drive shaft with an offset pin offset from the drive shaft axis by an amount equal to the orbital radius; and wherein the drive shaft is supported such that the drive shaft axis remains parallel with the rotor axis as the rotor axis orbits, without flexure of the drive shaft, and without an articulating joint between the drive shaft and rotor.

Statement 15. The positive displacement motor of Statement 14, further comprising: a rotor bearing supporting relative rotation between the drive shaft and rotor about the rotor axis.

Statement 16. The positive displacement motor of Statement 14 or 15, further comprising: a drive shaft bearing supporting rotation of the drive shaft about the drive shaft axis.

Statement 17. The positive displacement motor of any of Statements 14 to 16, further comprising a housing, wherein the drive shaft bearing radially secures the drive shaft within the housing.

Statement 18. The positive displacement motor of any of Statements 14 to 17, wherein the drive shaft bearing aligns the drive shaft axis with the stator axis.

Statement 19. The positive displacement motor of any of Statement 14 to 18, wherein the rotor is disposed inside the stator.

Statement 20. The positive displacement motor of any of Statements 14 to 18, wherein the stator is disposed inside the rotor.

Statement 21. A drilling method, comprising positioning a bottom hole assembly including a drill bit downhole; flowing a pressurized fluid through a plurality of cavities defined between a rotor and a stator, such that a rotor axis orbits about an orbital axis; applying a tangential force from the rotor to the drive shaft at a moment arm about a drive shaft axis such that the orbiting of the rotor drives rotation of the drive shaft; and applying the rotation of the drive shaft to the drill bit to rotate the drill bit.

Statement 22. The drilling method of Statement 20, wherein the rotor is coupled to the drive shaft with an offset pin offset from the drive shaft axis, and the tangential force from the rotor is applied to the drive shaft via the offset pin.

Statement 23. The drilling method of Statement 21, wherein the offset pin is offset from the drive shaft axis by an amount equal to an orbital radius of the rotor.

Statement 24. The drilling method of Statement 23, further comprising supporting the drive shaft such that the drive shaft axis remains parallel with the rotor axis as the rotor axis orbits, without flexure of the drive shaft, and without an articulating joint between the drive shaft and rotor.

The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A rotary transfer mechanism for use downhole, comprising:

a stator having a plurality of helical stator lobes;

a rotor having a rotor axis and a plurality of helical rotor lobes disposed about the rotor axis, the stator lobes and rotor lobes cooperating to define a plurality of cavities between the rotor and stator, such that the rotor rotates about the rotor axis while the rotor orbits about a stator axis;

a drive shaft rotatably supported about a drive shaft axis; and wherein the rotor is directly coupled to the drive shaft at a radial offset from the drive shaft axis.

2. The rotary transfer mechanism of claim 1, wherein the drive shaft is coaxial with the stator, and the rotor axis is at the radial offset from the drive shaft axis.

3. The rotary transfer mechanism of claim 2, wherein the radial offset is equal to an orbital radius of the rotor axis about the stator axis.

4. The rotary transfer mechanism of claim 1, wherein the rotor is coupled to the drive shaft using an offset pin that is coaxial with the rotor and radially offset from the drive shaft axis.

5. The rotary transfer mechanism of claim 1, further comprising one or both of a rotor bearing supporting relative rotation between the drive shaft and rotor about the rotor axis and a drive shaft bearing supporting rotation of the drive shaft about the drive shaft axis.

6. The rotary transfer mechanism of claim 5, further comprising a housing, wherein the drive shaft bearing radially secures the drive shaft within the housing.

7. The rotary transfer mechanism of claim 6, wherein the drive shaft bearing holds the drive shaft axis in alignment with the stator axis.

8. The rotary transfer mechanism of claim 1, wherein the drive shaft is supported such that the drive shaft axis remains parallel with the rotor axis as the rotor axis orbits.

9. The rotary transfer mechanism of claim 8, wherein the rotor orbits without flexure of the drive shaft.

10. The rotary transfer mechanism of claim 8, wherein the drive shaft is supported without an articulating joint at either end.

11. The rotary transfer mechanism of claim 1, wherein the stator axis does not align with the drive shaft axis.

12. The rotary transfer mechanism of claim 1, further comprising a gearbox coupled between the drive shaft and drill bit to reduce a drill bit speed relative to a drive shaft speed.

13. The downhole rotary transfer mechanism of claim 1, wherein the rotor and stator cooperate as a motor with a pressurized fluid source in fluid communication with the plurality of cavities to drive the rotor with respect to the stator.

14. A positive displacement motor, comprising:

a stator having a stator axis and a plurality of helical stator lobes disposed about the stator axis;

a rotor having a rotor axis and a plurality of helical rotor lobes disposed about the rotor axis, the stator lobes and rotor lobes cooperating to define a plurality of cavities between the rotor and stator;

a pressurized fluid source in fluid communication with the plurality of cavities to drive rotation of the rotor with respect to the stator such that the rotor axis orbits at an orbital radius about the stator axis while the rotor rotates about the rotor axis;

a drive shaft rotatably supported about a drive shaft axis, wherein the rotor is directly coupled to the drive shaft with an offset pin offset from the drive shaft axis by an amount equal to the orbital radius; and wherein the drive shaft is supported such that the drive shaft axis remains parallel with the rotor axis as the rotor axis orbits, without flexure of the drive shaft, and without an articulating joint between the drive shaft and rotor.

15. The positive displacement motor of claim 14, further comprising:

one or both of a rotor bearing and a drive shaft bearing, the rotor bearing supporting relative rotation between the drive shaft and rotor about the rotor axis, the drive shaft bearing supporting rotation of the drive shaft about the drive shaft axis.

16. The positive displacement motor of claim 15, further comprising a housing, wherein the drive shaft bearing radially secures the drive shaft within the housing and aligns the drive shaft axis with the stator axis.

17. A drilling method, comprising:

positioning a bottom hole assembly including a drill bit downhole;

flowing a pressurized fluid source through a plurality of cavities defined between a rotor and a stator, such that a rotor axis orbits about an orbital axis;

applying a tangential force from the rotor to the drive shaft with the rotor directly coupled to the drive shaft at a moment arm about the drive shaft axis such that the orbiting of the rotor drives rotation of the drive shaft; and applying the rotation of the drive shaft to the drill bit to rotate the drill bit.

18. The drilling method of claim 17, wherein the rotor is coupled to the drive shaft with an offset pin offset from the drive shaft axis, with a resulting torque applied to the drive shaft via the offset pin.

19. The drilling method of claim 18, wherein the offset pin is offset from the drive shaft axis by an amount equal to an orbital radius of the rotor.

20. The drilling method of claim 19, further comprising:

supporting the drive shaft such that the drive shaft axis remains parallel with the rotor axis as the rotor axis orbits, without flexure of the drive shaft, and without an articulating joint between the drive shaft and rotor.

* * * * *